US009587387B2

(12) United States Patent
Zhang et al.

(10) Patent No.: US 9,587,387 B2
(45) Date of Patent: Mar. 7, 2017

(54) DUAL-DRAINAGE SWITCHING MECHANISM OF WATER TANK

(75) Inventors: Rongyu Zhang, Xiamen (CN); Xingdong Wang, Xiamen (CN); Bing Wang, Xiamen (CN)

(73) Assignee: XIAMEN R&T PLUMBING TECHNOLOGY CO., LTD., Xiamen (CN)

( * ) Notice: Subject to any disclaimer, the term of this patent is extended or adjusted under 35 U.S.C. 154(b) by 1095 days.

(21) Appl. No.: 13/593,379

(22) Filed: Aug. 23, 2012

(65) Prior Publication Data

US 2013/0161333 A1 Jun. 27, 2013

(30) Foreign Application Priority Data

Dec. 27, 2011 (CN) ..... 2011 1 0443607

(51) Int. Cl.
*E03D 1/14* (2006.01)
*E03D 1/35* (2006.01)

(52) U.S. Cl.
CPC *E03D 1/14* (2013.01); *E03D 1/35* (2013.01)

(58) Field of Classification Search
CPC E03D 1/14; E03D 1/141; E03D 1/145; E03D 1/35
USPC ..... 4/324, 334, 332
See application file for complete search history.

(56) References Cited

U.S. PATENT DOCUMENTS 7,010,816 B2 * 3/2006 Li ..... E03D 3/12 4/354

FOREIGN PATENT DOCUMENTS

CN 102268894 A 12/2011

* cited by examiner

*Primary Examiner* — Lauren Crane
(74) *Attorney, Agent, or Firm* — Rabin & Berdo, P.C.

(57) ABSTRACT

A dual-drainage switching mechanism of water tank has: a water container with bottom opening of the inner cavity, an air vent communicating with the inner cavity is arranged on the sealed top; a valve unit used for controlling opens or closes of the air vent; a drain valve controller comprising a partial flush button and a full flush button, and the air vent is opened through the linking and coupling of the full flush button and the valve unit, and the air vent is closed through the linking and coupling of the partial flush button and the valve unit. The dual-draining switch is achieved through hermetically storing or non-hermetically controlling part of water body in the inner cavity of the water container, traditional one-pressing drain valve can be transformed into the draining control mechanism with dual-draining function.

26 Claims, 11 Drawing Sheets

DUAL-DRAINAGE SWITCHING MECHANISM OF WATER TANK

FIELD OF THE INVENTION

The present invention relates to displacement control mechanism of the water tank in bathroom, more particularly to a dual-drainage switching mechanism of water tank.

BACKGROUND OF THE INVENTION

The one-pressing or dual-pressing drain valve is mounted in the bathroom water tank in the domestic or oversea markets, the draining function of the one-pressing drain valve is single, and the dual-pressing is drain valve can achieve two different drainage in one water tank. It wastes a lot of water during flushing process for the water tank with one-pressing drain cannot achieve the control function of switching partial flush and full flush. Two different working water levels of the drain valve decides the control of the drainage of the water tank, such as, for the water tank drainage control of the flapper-type drain valve, the draining water level of the water tank is controlled through opening one of the two seal flappers or opening both seal flappers simultaneously which are arranged with different height in the drain valve, so that the drainages of two water levels of the water tank are achieved, or the counter weight of the flapper is controlled to get different time of that the flappers seals the drain valve outlet base to solve the control of the partial flush and full flush of the water tank; but the ways mentioned above are still the control of the water level in the water tank with complicated structure and low accuracy of switching control of water volume, and it still cannot optimized the utilization of the water resource in the water tank, and still waste water resource.

SUMMARY OF THE INVENTION

The object of the present invention is to offer a dual-drainage switching mechanism of water tank with simple structure and good accuracy of switching control of two kinds of drainage, the container within part of water body in the water tank is controlled to switch between the sealing state and the unsealing state under atmospheric pressure, so that two different kinds of drainage of the water tank are achieved.

In order to achieve the above object, the present invention offers a dual-drainage switching mechanism of water tank, it comprises: A water container with bottom opening of the inner cavity, an air vent communicating with the inner cavity is arranged on the sealed top of the water container; A valve unit used for controlling opens or closes of the air vent; A drain valve controller comprising a partial flush button and a full flush button; the air vent is opened through the linking and coupling of the full flush button and the valve unit, and the air vent is closed through the linking and coupling of the partial flush button and the valve unit.

A pressure relief device used for exhausting when the inner pressure of the water container is greater than atmospheric pressure is arranged on the water container. When the valve unit is at normal close state, the air in the inner cavity is gradually compressed and affects the rising speed of the water level when water is filled into the water container, the balance between the air pressure in the inner cavity and the external atmospheric pressure is kept by adding the pressure relief device, and then the water filling speed is accelerated; when the valve unit is at normal open state, the pressure relief device is not needed because the inner cavity of the water container keeps communicating with the external atmospheric pressure.

The pressure relief device is arranged on the valve unit, the exhausting and inhaling of the air vent is controlled through the coupling of the pressure relief device and the air vent controlled by the valve unit; when the air vent is sealed by the valve unit, the pressure in the water container is relieved through the pressure relief device, and when air enters the air vent, the pressure relief device is separated from the air vent through the valve unit.

The valve unit comprises a fixed seat fixed on the top of the water container, a oscillating rod linked with the drain valve controller, the middle of the bottom of the oscillating rod is connected to the fixed seat in a swinging manner through the pin roll, a seal cover sealing the air vent is arranged at one end of the oscillating rod; when the air vent is pressed by the end of the oscillating rod mounting with the seal cover, the seal cover is hermetically coupling with the air vent; when the end of the oscillating rod mounting with the seal cover upturns and is separated from the air vent, the air vent is open to ventilate.

The seal cover on the oscillating rod of the valve unit is a pressure relief device formed by a thin rubber piece, when the pressure in the inner cavity of the water container is greater than the external atmosphere, the edge of the rubber piece upturns elastically to form a gap with the air vent, and the gap reliefs the pressure in the inner cavity of the water container; the inner cavity of the water container is raised horizontally, the pressure in the inner cavity of the water container is increased, the gap between the inner cavity and the air vent is formed through the elastic deformation of the rubber piece, and the gap is used for exhausting to relieve the pressure in the inner cavity of the water container; when the exhausting is finished, the water body in the inner cavity of the water container is sealed and is stored under the pressing effect of atmospheric pressure; as long as the bottom opening of the inner cavity of the water container does not leave the water surface, the top of the inner cavity of the water container is still sealed, and the lifting of the water level of the water body out of the water container will not affect the water body in the inner cavity.

A pressing end face which opens the valve unit when the full flush button of the drain valve controller presses the oscillating rod is arranged at one end of the oscillating rod of the valve unit; the pressing end face is pressed downward, the end of the oscillating rod mounting with the seal cover upturns, and the seal cover is separated from the air vent to open the air vent, the water body in the inner cavity is not sealed, and the water body in the inner cavity of the water container is under the external atmospheric pressure, namely the water body in the inner cavity of the water container can flow out.

A resetting rod which pulls and raises the oscillating rod to forcedly close the valve unit when the partial flush button of the drain valve controller returns is arranged at another end of the oscillating rod of the valve unit; the end of the oscillating rod mounting with the seal cover is pressed down through pulling and raising the resetting rod, and the air vent is sealed by the seal cover, and the top of the inner cavity of the water container is sealed.

A counter weight cavity and a buckling cover that buckles and covers the counter weight cavity are arranged in the oscillating rod of the valve unit, a steel ball that can rolls back and forth in the counter weight cavity along two ends of the oscillating rod is arranged in the counter weight cavity; the steel ball in the counter weight cavity can increase the sensitivity and reliability of the swinging of the oscillating rod, and when half draining, the steel ball is at the end of the counter weight cavity close to the seal cover, and the air vent is sure to be closed when the seal cover on the oscillating rod of the valve unit is pressed down.

The drain valve controller also comprises a button support that is fixed above the water container, the partial flush button and the full flush button are respectively sleeved with partial flush button return spring and full flush button return spring and are both mounted on the button support, a swing arm of which one end is actively connected to the valve rod of the drain valve is hinged under the button support, the partial flush button and the full flush button are linked to and coupling with the swing arm; the full flush button keeps still when the partial flush button is pressed, and the full flush button drives the partial flush button to move together when the full flush button is pressed.

A strut used for pressing the pressing end face is fixed on the bottom of the full flush button, and the strut is above the pressing end face of the oscillating rod of the valve unit; the full flush button makes the oscillating rod swing when the pressing end face is pressed down by the strut, so that the air vent is opened by the valve unit.

A pull rod is arranged under the partial flush button of the drain valve controller, a elongated hang hole is arranged on the pull rod, the top end of the pull rod is hinged to another end of the swing arm, the resetting rod of the oscillating rod of the valve unit is plunged and coupling with the elongated hang hole. The end of the swing arm mounting with the pull rod is rotated downward through the pressing of the partial flush button, the elongated hang hole of the pull rod gives way to the resetting rod, when the partial flush button is reset, the pull rod is driven to rise through the upturning of the swing arm, and the resetting rod is pulled and raised by the elongated hang hole, so that the air vent is closed by the valve unit.

A normal pressure cavity isolated from the inner cavity and used for mounting the drain valve is arranged in the water container, the top opening of the normal pressure cavity is opened on the sealed top of the water container; a draining container is further arranged out of the water container to sleeved with the water container; a mounting hole for mounting the drain valve base is arranged on the bottom surface of the draining container, at least one water inlet is arranged on the bottom of the side wall of the water container, and at least one passage hole that is communicated with and fits the water inlet is arranged on the side of the draining container. Water in the water tank is guided into the inner cavity of the water container through the water inlet and the passage hole, and the mounting hole is communicated with the bottom opening of the water container, when the inner cavity of the water container is communicated with atmospheric pressure through the air vent, water in the inner cavity of the water container can be discharged out of the water tank through the drain valve base at the mounting hole.

Two location holes arranged at the two side walls of the draining container, and a batten is inserted in the two location holes, one end of the batten is locked with the draining container another end is fixed connected through a buckle, the batten is used for pressing the water container to fix to and sleeved with draining container.

An air bleeder communicating with the inner cavity is arranged on is the top of the water container, the pressure relief device is a exhausting check valve, and the exhausting check valve is connected to the air bleeder. The inner cavity of the water container is exhausted by the exhaust check valve, and the seal cover is a rubber piece with no edge upturning, so that the valve unit can only control the air inflow of the air vent, and the air vent is not used for exhausting and pressure relief.

When the technical proposal mentioned above is used, and the present invention is mounted in the bathroom toilet water tank, the inlet water level of the water tank rises, the pressure in the inner cavity of the water container is exhausted and relieved through the pressure relief device on the air vent; after pressure in the inner cavity of the water container is relieved, the air vent is still closed and the inner cavity of the water container is still sealed by the pressure relief device under the control of the valve unit, whether the inner cavity of the water container is or is not filled with water, the water body in the water container is still be stored and kept in the inner cavity by atmospheric pressure; the partial flush button is pressed to open the drain valve, water in the water tank out of the inner cavity of the water container is drained through the drain valve, the water level in the water tank falls, the water body in the inner cavity of the water container cannot flow out because it is pressed in the inner cavity by atmospheric pressure, and the partial flush function is achieved; when the full flush button is pressed and the drain valve is turned on, the air vent is opened by the valve unit by pressing the full flush button, the inner cavity of the water container is communicated with external atmospheric pressure, so that water in and out of the inner cavity of the water container is under atmospheric pressure and is drained out of the water tank by the drain valve through water gravity, and the full flush function is achieved. Namely the dual-draining switch is achieved through hermetically storing or non-hermetically controlling part of water body in the inner cavity of the water container in the present invention, traditional one-pressing drain valve can be transformed into the draining control mechanism with dual-draining function.

The benefits of the present invention are: the water body in the inner cavity of the water container is hermetically stored, the air vent is opened by the valve unit linked with the full flush button and air is sucked in, the seal of the water body in the inner cavity of the water container is relieved, so that water in the inner cavity can flow out, namely part of the water body in the inner cavity of the water container in the water tank is switched between seal state and unseal state under atmospheric pressure, so that the dual-draining function of the water tank is achieved.

REFERENCE SIGNS

10 water container; 11 inner cavity; 12 bottom opening; 13 sealed top; 14 air vent; 15 water inlet; 16 normal pressure cavity; 17 top opening of the normal pressure cavity; 18 air bleeder;

20 valve unit; 21 fixed seat; 22 oscillating rod; 23 pin roll; 24 pressing end face; 25 resetting rod; 26 seal cover; 27 counter weight cavity; 28 steel ball; 29 buckling cover;

30 drain valve controller; 31 button support; 32 partial flush button; 321 the returning spring of the partial flush button; 33 full flush button; 331 the returning spring of the full flush button; 34 swing arm; 35 pull rod; 351 elongated hang hole; 36 struts;

40 draining container; 41 mounting hole; 42 passage hole; 43 location hole;

50 batten; 51 buckle;

60 drain valve; 61 drain valve body; 62 drain valve base; 63 valve rod; 64 drain sealing gasket;

70 water tank;

80 inlet valve;

90 check valve.

DESCRIPTION OF THE PREFERRED EMBODIMENTS

With the following description of the drawings and specific embodiments, the invention shall be further described in details.

Embodiment 1

An Air Vent for Exhausting Inhaling is Arranged on the Top of the Water Container A dual-drainage switching mechanism of water tank shown in FIG. 1 to FIG. 5 is mainly composed of a water container 10, a valve unit 20 and a drain valve controller 30.

Figure 1:
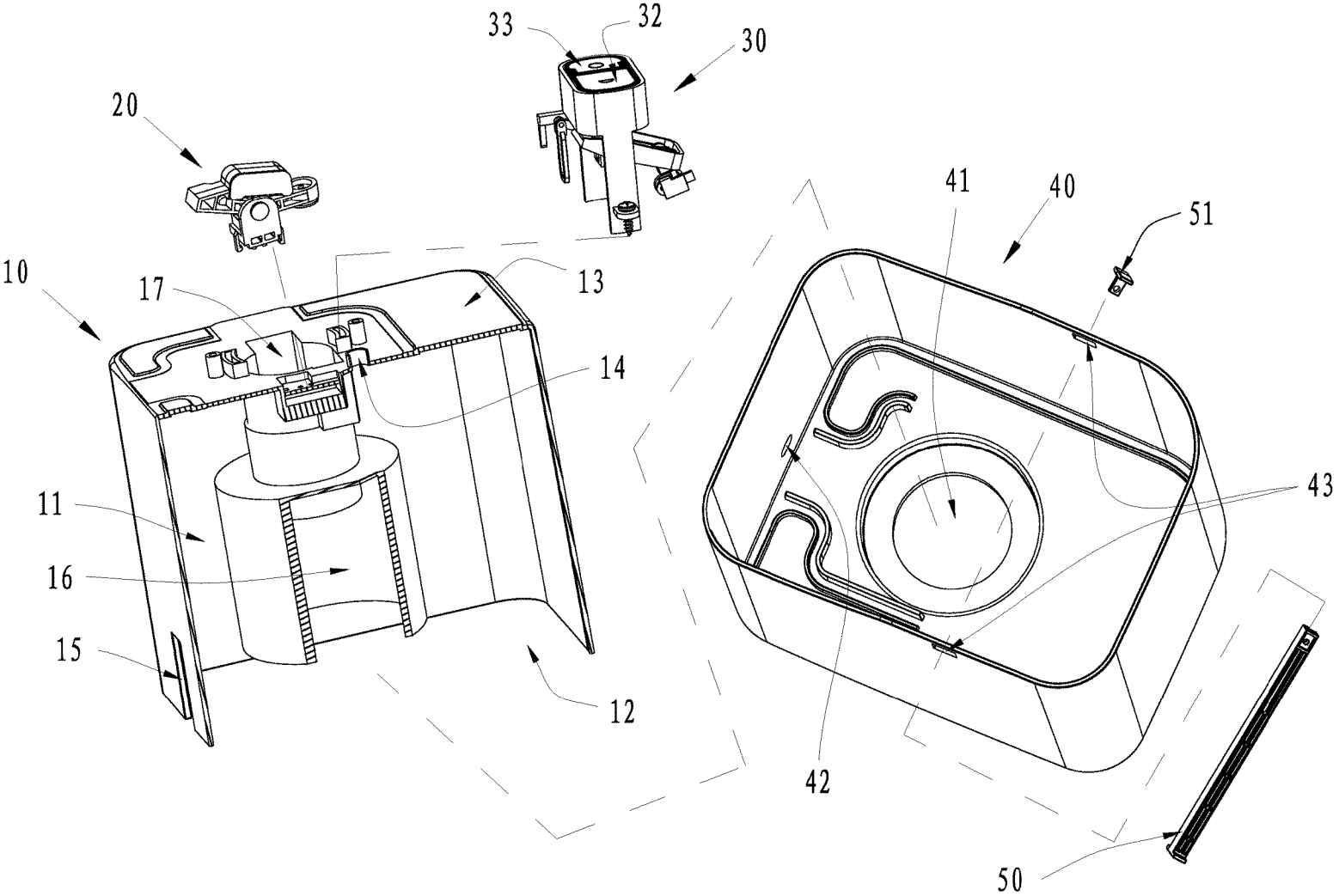
FIG. 1 shows the solid assembly exploded view of the embodiment 1 in the present invention.

As shown in FIG. 1, the inner cavity 11 of the water container 10 is provided with a bottom opening 12 and a sealed top 13, an air vent communicating with the inner cavity 11 is arranged on the sealed top 13, a water inlet 15 is arranged on the bottom of the side wall of the water container 10, and a normal pressure cavity 16 isolated from the inner cavity 11 and used for mounting the drain valve is arranged in the inner cavity 11, the top opening 17 of the normal pressure cavity 16 is opened on the sealed top 13 of the water container 10.

As shown in FIG. 1 to FIG. 4, the valve unit 20 for controlling the air vent open or close is fixed in the sealed top 13 of the water container 10, the valve unit 20 comprises a fixed seat fixed on the sealed top 13 of the water container 10, a oscillating rod 22 linked with the drain valve controller 30, a pressing end face 24 which opens the valve unit 20 when the full flush button 33 of the drain valve controller presses the oscillating rod 22 is arranged at one end of the oscillating rod 22, and a resetting rod 25 which pulls and raises the oscillating rod 22 to forcedly close the valve unit 20 when the partial flush button 32 of the drain valve controller 30 returns is arranged at this end, the middle of the bottom of the oscillating rod 22 is connected to the fixed seat 21 in a swinging manner through the pin roll 23, a counter weight cavity 27 and a buckling cover 29 that buckles and covers the counter weight cavity 27 are arranged in the oscillating rod 22, a steel ball 28 that can rolls back and forth in the counter weight cavity 27 along two ends of the oscillating rod 22 is arranged in the counter weight cavity 27; a seal cover that seals the air vent 14 is arranged at another end of the oscillating rod 22, and the seal cover 26 on the oscillating rod 22 is a pressure relief device formed by a thin rubber piece, when the pressure in the inner cavity 11 of the water container 10 is greater than the external atmosphere, the edge of the rubber piece upturns elastically to form a gap with the air vent 14, and the gap reliefs the pressure in the inner cavity 11 of the water container 10.

As shown in FIG. 1 to FIG. 4, the drain valve controller 30 linked with the valve unit 20 also comprises a button support 31 that is fixed on the seal cover 13 of the inner cavity 11 of the water container 10, the partial flush button 32 and the full flush button 33 are respectively sleeved with partial flush button return spring 321 and full flush button return spring 331 and are both mounted on the button support 31, a swing arm 34 of which one end is actively connected to the valve rod of the drain valve is hinged under the button support 31, the partial flush button 32 and the full flush button 33 are linked to and coupling with the swing arm 34; the full flush button 33 keeps still when the partial flush button 32 is pressed, and the full flush button 33 drives the partial flush button 32 to move together when the full flush button 33 is pressed, and a strut 36 used for pressing the pressing end face 24 is fixed on the bottom of the full flush button 33, and the strut 36 is above the pressing end face 24 of the oscillating rod 22 of the valve unit 20, and a pull rod 35 is arranged under the partial flush button 32, a elongated hang hole 351 is arranged on the pull rod 35, the top end of the pull rod 35 is hinged to the end of the swing arm 34 which is coupling with the resetting rod 25, the resetting rod 25 of the oscillating rod 22 of the valve unit 20 is plunged and coupling with the elongated hang hole 351.

Figure 2:
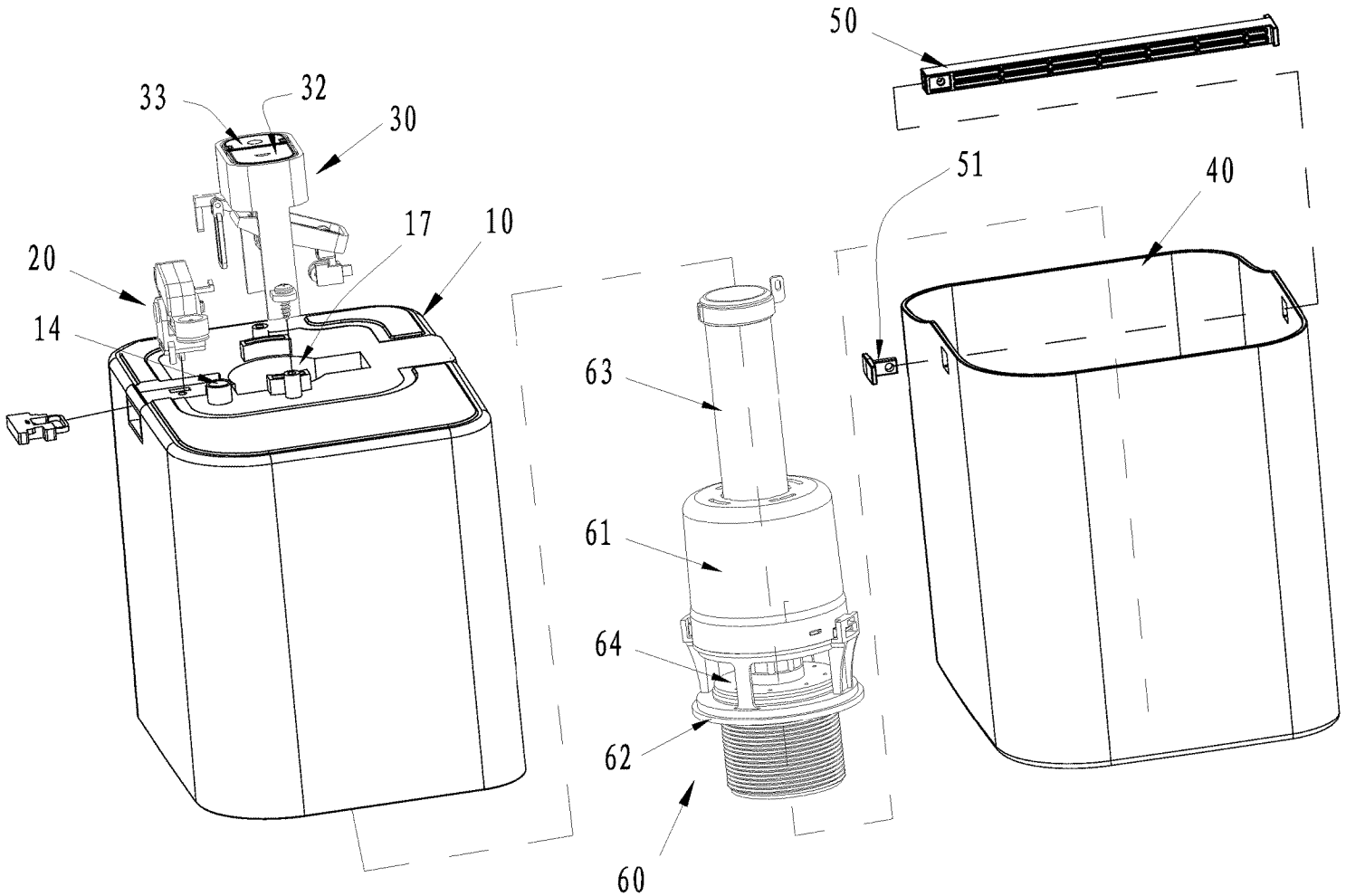
FIG. 2 shows the solid exploded view of the assembly of the drain valve of the embodiment 1 in the present invention.
Figure 3:
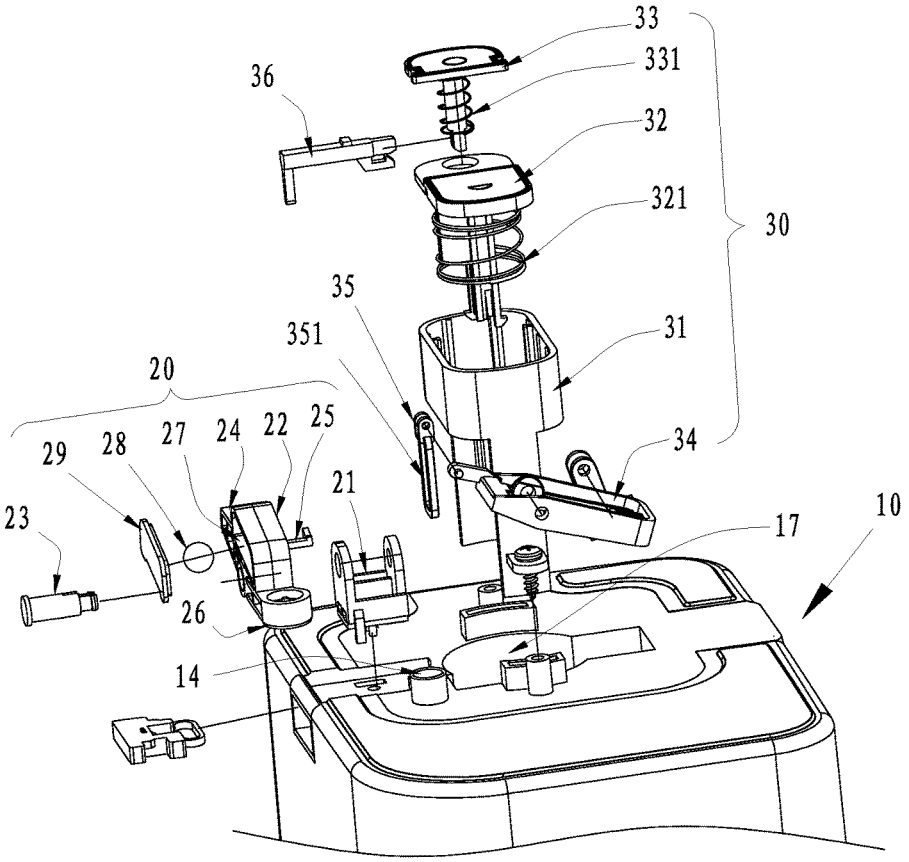
FIG. 3 shows the solid exploded view of the water container with valve unit and drain valve controller of the embodiment 1 in the present invention.
Figure 4:
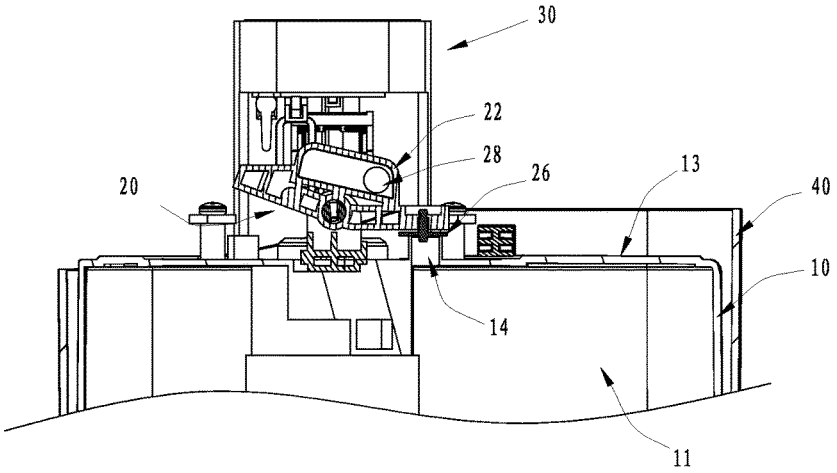
FIG. 4 shows the exploded view of the embodiment 1 in the present invention.

As shown in FIG. 1 and FIG. 2, a draining container 40 is further arranged out of the water container 10 to sleeved with the water container 10; a mounting hole 41 for mounting the drain valve base is arranged on the bottom surface of the draining container 40, at least one passage hole 42 that is communicated with and fits the water inlet 15 on is the bottom of the side wall of the water container 40 is arranged on the side wall of the draining container 40; two location holes 43 arranged at the two side walls of the draining container 40, and a batten 50 is inserted in the two location holes 43, one end of the batten 50 is locked with the draining container 40, another end is fixed connected through a buckle 51, the batten 50 is used for pressing the water container 10 to fix to and sleeved with draining container 40.

Figure 5:
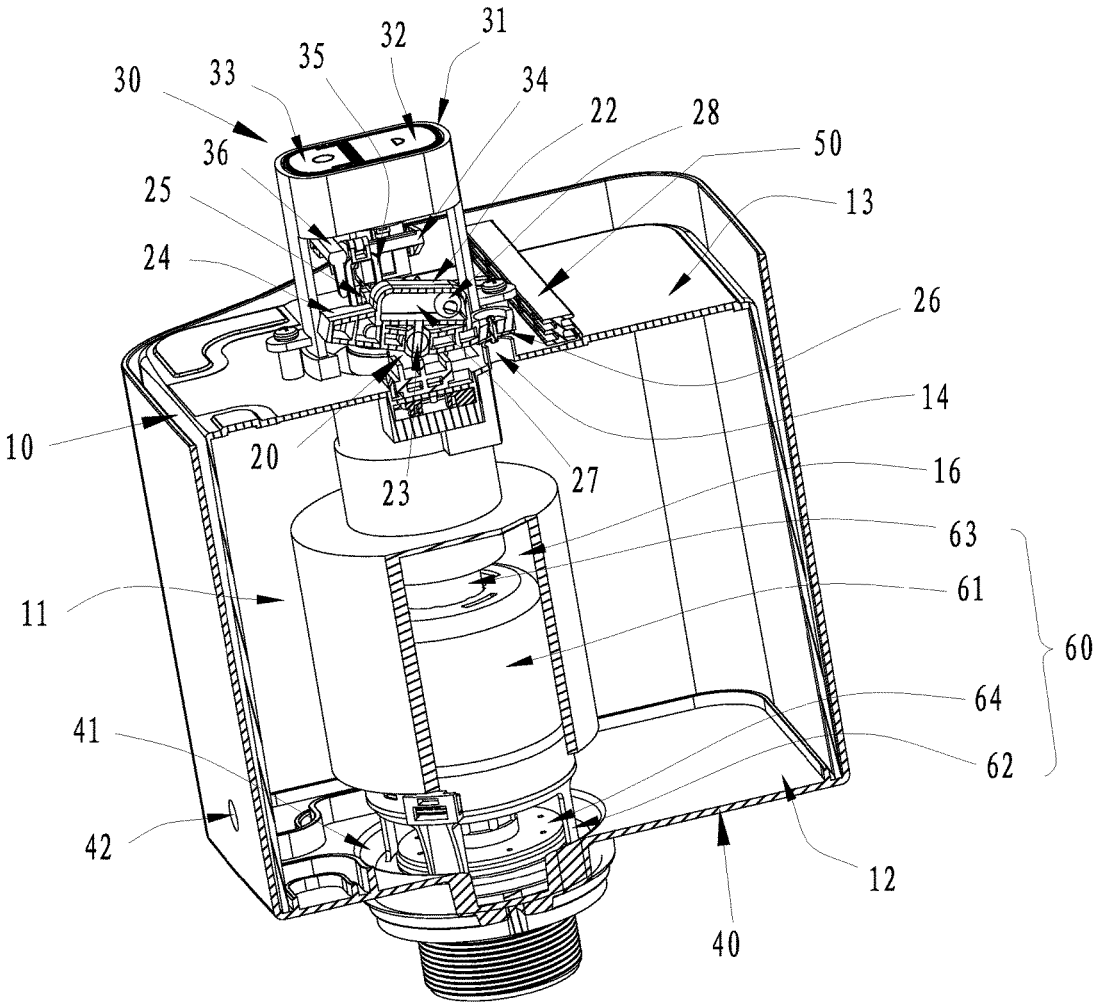
FIG. 5 shows the solid structural sectional view of the embodiment 1 in the present invention after the whole drain valve is completely assembled.
Figure 6:
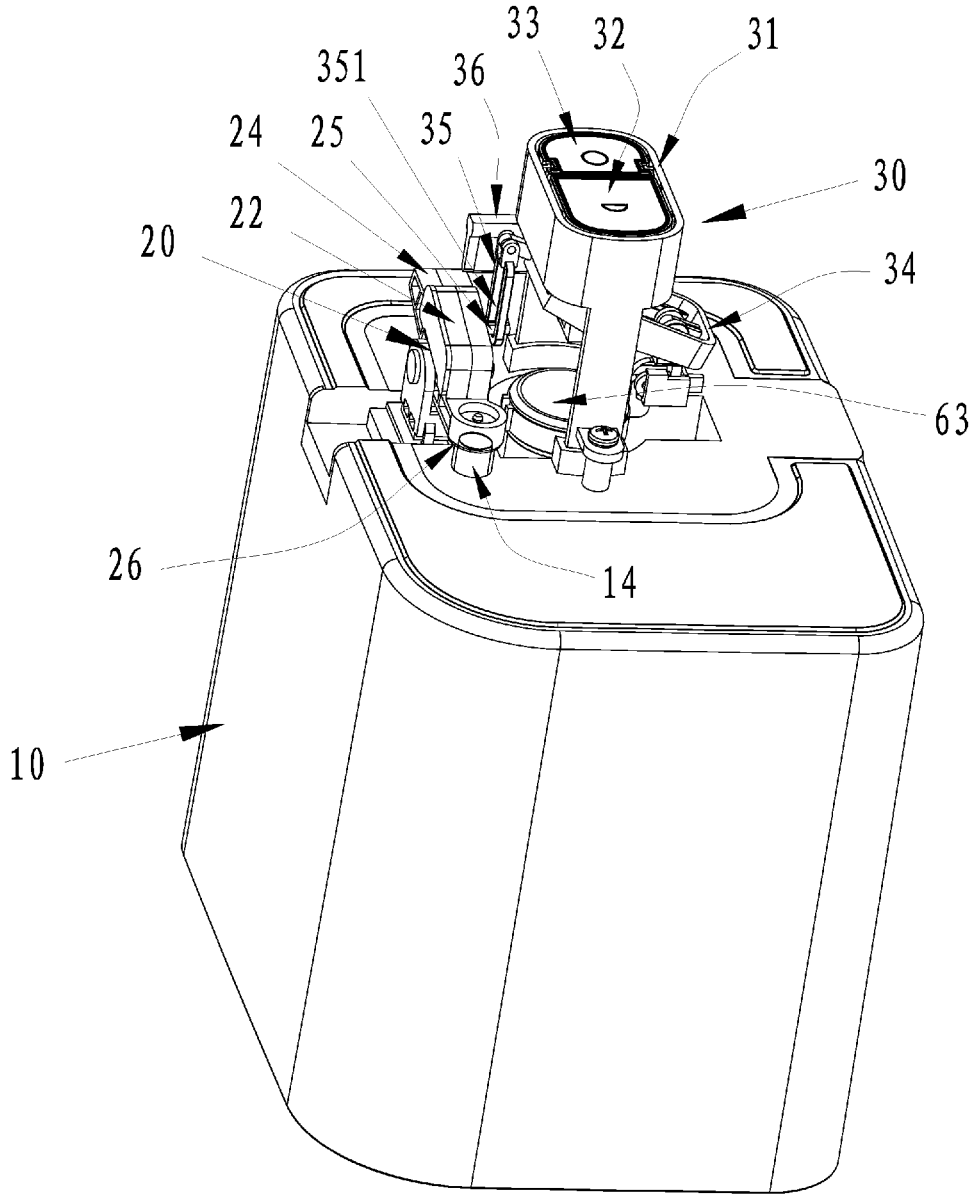
FIG. 6 shows the solid structural sectional view of the embodiment 1 in the present invention when it is at initial state.

As shown in FIGS. 1, 2 and 5, the valve unit 20 and the drain valve controller 30 are first mounted on the sealed top 13 of the water container 10, and the drain valve base 62 is fixed in the mounting hole 41 on the bottom of the draining container 40, and then the drain valve 60 composed of the drain valve body 61, the drain valve base 62, the valve rod 63 and drain sealing gasket 61 connected to the bottom end of the valve rod 63 is fixed in the draining container 40, and then the water container 10 is sleeved in the draining container 40 from top to bottom, and the valve body 61 of the drain valve 60 is sleeved in the normal pressure cavity 16 arranged on the water container 40, the valve rod 63 of the drain valve 60 is located in the top opening 17 of the normal pressure cavity, and the bottom opening 12 of the inner cavity 11 of the water container 10 is located on the bottom surface of the draining container 20, the passage hole 42 on the side of the draining container 40 is fit to and communicated with the water inlet 15 of the water container 10, and one end of the swing arm 34 of the drain valve controller 30 is actively hinged with the top end of the valve rod 63 of the drain valve 60 through connector; a batten 50 is inserted in the location holes 43 of the two side walls of the draining container 40, one end of the batten 50 is locked with the draining container 40, another end is fixed connected through a buckle 51, and the batten 50 presses the water container 10 to fix to and sleeved with draining container 40 to finish the assembly of the present invention.

The specific working principle and implementing action are illustrated below in details.

Figure 9:
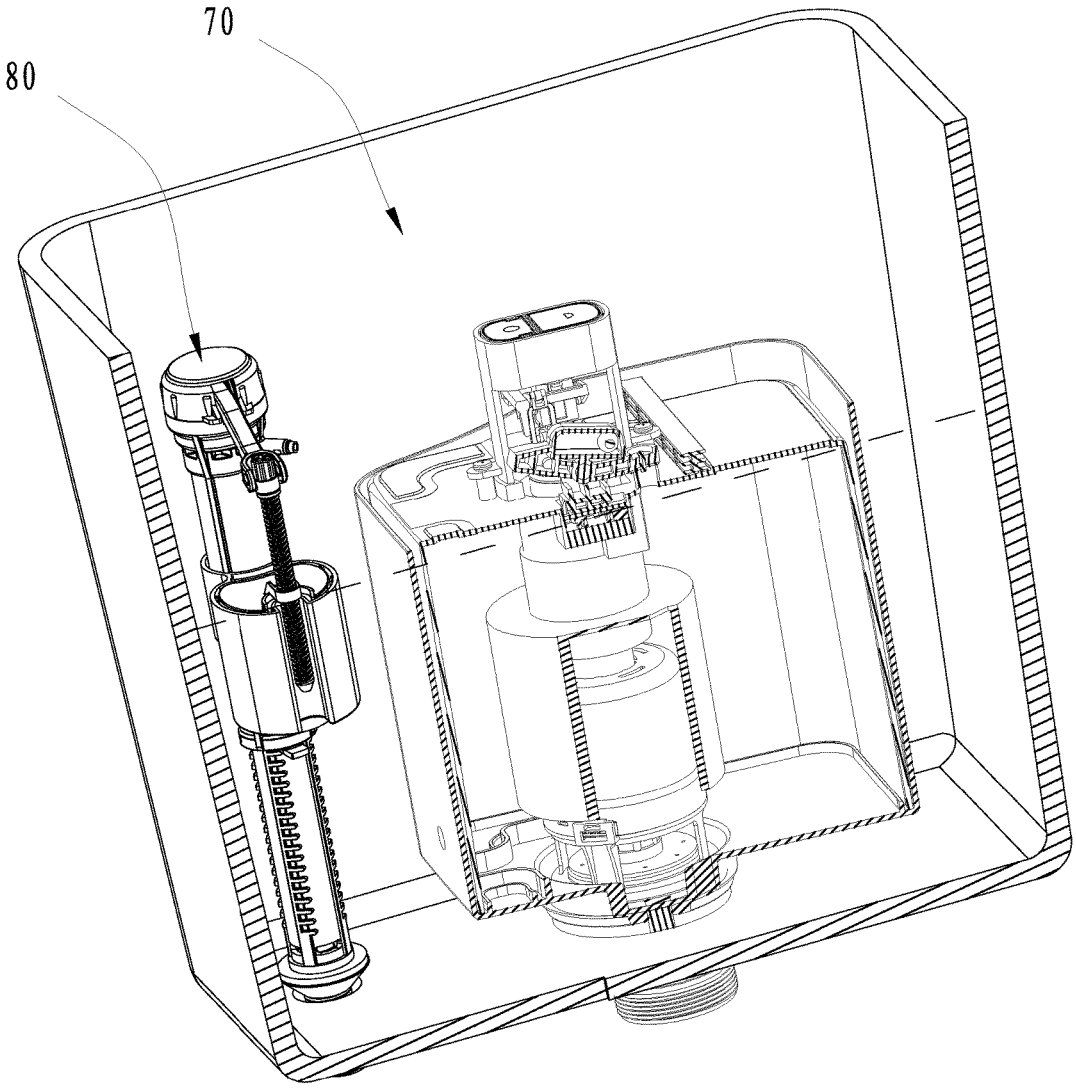
FIG. 9 shows the solid structural sectional view of the embodiment 1 in the present invention when it is mounted in the bathroom water tank.

As shown in FIG. 5 and FIG. 9, the present invention is mounted in the water tank 70, and a inlet valve 80 is also mounted in the water tank 70.

As shown in FIG. 9, FIG. 4 to FIG. 6, the present invention is at initial state, and the swing arm 34 is pulled down by the valve rod 63 of the drain valve 60 through gravity, the drain valve base 62 is sealed by the drain sealing gasket 64 at the bottom of the valve rod 63, another end of the swing arm 34 upwarps and pulls up the pull rod 35, and the resetting rod 25 of the oscillating rod 22 is pulled and raised by the elongated hang hole 351 of the pull rod 35, and the end of the oscillating rod 22 mounting with seal cover 26 is pressed down, and the steel ball 28 in the counter weight cavity of the oscillating rod 22 is close to the end with seal cover 26, the air vent 14 of the water container 10 is sealed by the seal cover 26, namely the air vent 14 is closed by the valve unit 20 at the initial state of the present invention. The inlet valve 80 is turned on to inject water into the water tank 70, water in the water tank 70 enters the draining container 40 and the water container 10 through the passage hole 42 and the water inlet 15, and the water level in the water tank 70 rises, and the water level in the inner cavity 11 and the normal pressure cavity 16 of the water container 10 rises, and the air pressure backlogging in the inner cavity 11 of the water container 10 is increased, when the pressure in the inner cavity 11 of the water container 10 is greater than the external atmosphere, the edge of the rubber seal cover upturns elastically to form a gap with the air vent 14, and the gap relief the pressure in the inner cavity 11 of the water container 10, and the water stops entering the inlet valve 80, the water levels in the water tank 70, the inner cavity 11 and the normal pressure cavity 16 of the water container 10 are the same; at this moment, the water body in the inner cavity 11 of the water container 10 is sealed and stored by atmosphere and cannot flow out, the water in the water tank 70 and the normal pressure cavity 16 out of the inner cavity 11 of the water container 10 is under normal atmosphere.

Figure 7:
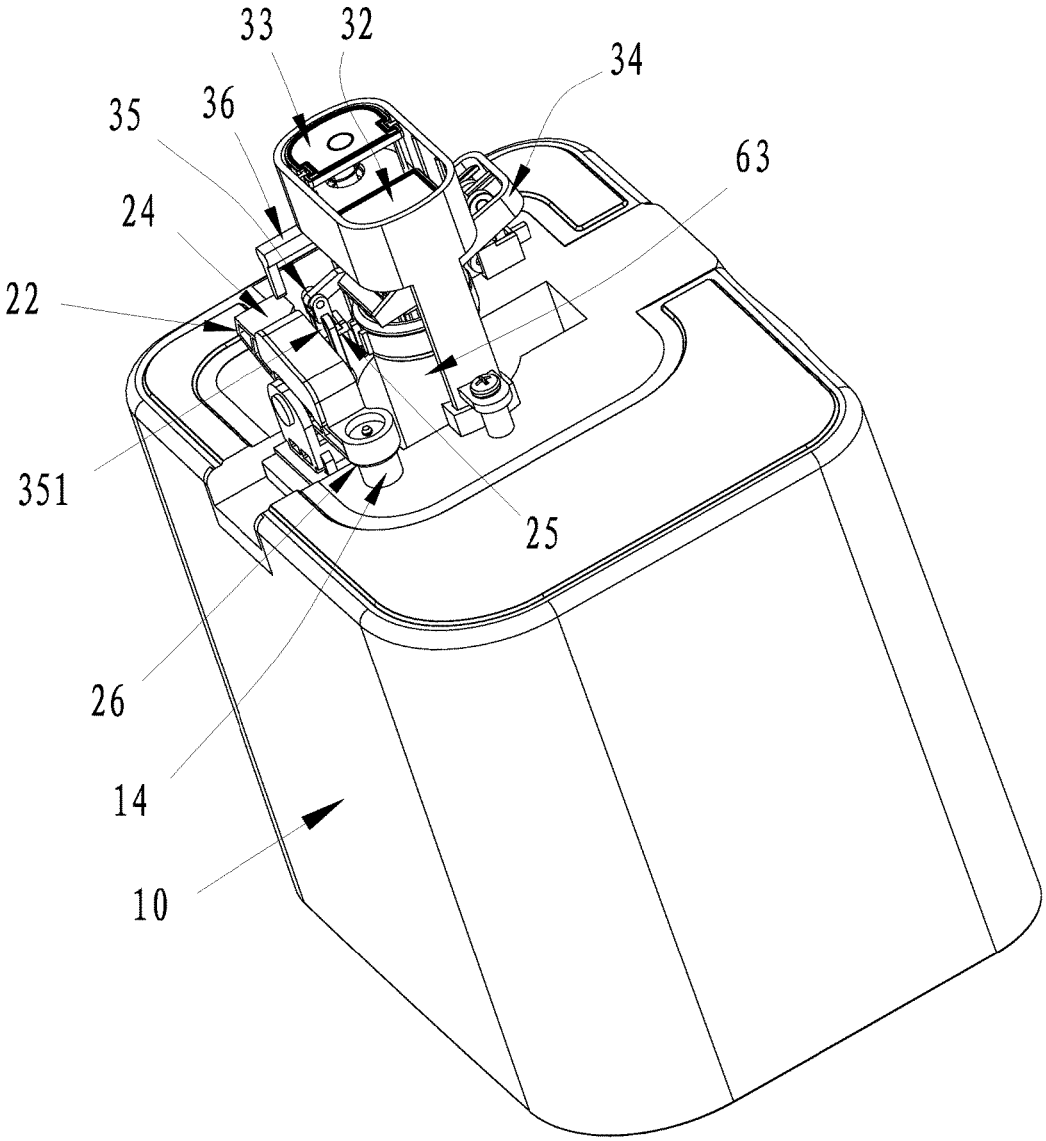
FIG. 7 shows the solid structural sectional view of the embodiment 1 in the present invention when it is at partial flush state.

When partial flush is needed, as shown in FIGS. 9, 5 and 7, the partial flush button 32 of the drain valve controller 30 is pressed, the partial flush button return spring 321 is compressed, and the full flush button keeps still 33, the pull rod 35 is driven down by one end of the swing arm 34, the elongated hang hole 351 of the pull rod 35 gives way to the resetting rod 25 of the oscillating rod 25, and the steel ball 28 in the oscillating rod 22 of the valve unit 20 is at the end mounting with the seal cover 26, and the air vent 14 is reliably sealed by the seal cover 26, and the water body in the inner cavity 11 of the water container 10 is sealed and stored by atmosphere; the valve rod 63 of the drain valve 60 is pulled up by the other end of the swing arm 34 on the drain valve controller 30, the drain sealing gasket 64 is pulled up from the outlet of drain valve base 62 by the valve rod 63, and water out of the inner cavity 11 of the water container 10 is discharged from the water outlet of the drain valve base 62 through the normal atmosphere environment and the gravity of water, and water in the inner cavity 11 of the water container 10 is sealed and stored by atmosphere and cannot flow out, and the partial flush function of the water tank 70 is achieved. When partial flush work is finished, the partial flush button 32 is reset through the partial flush button return spring 321, and the drain valve controller 30 is reset, and the valve unit 20 is reset, and the initial state of the present invention is reset.

Figure 8:
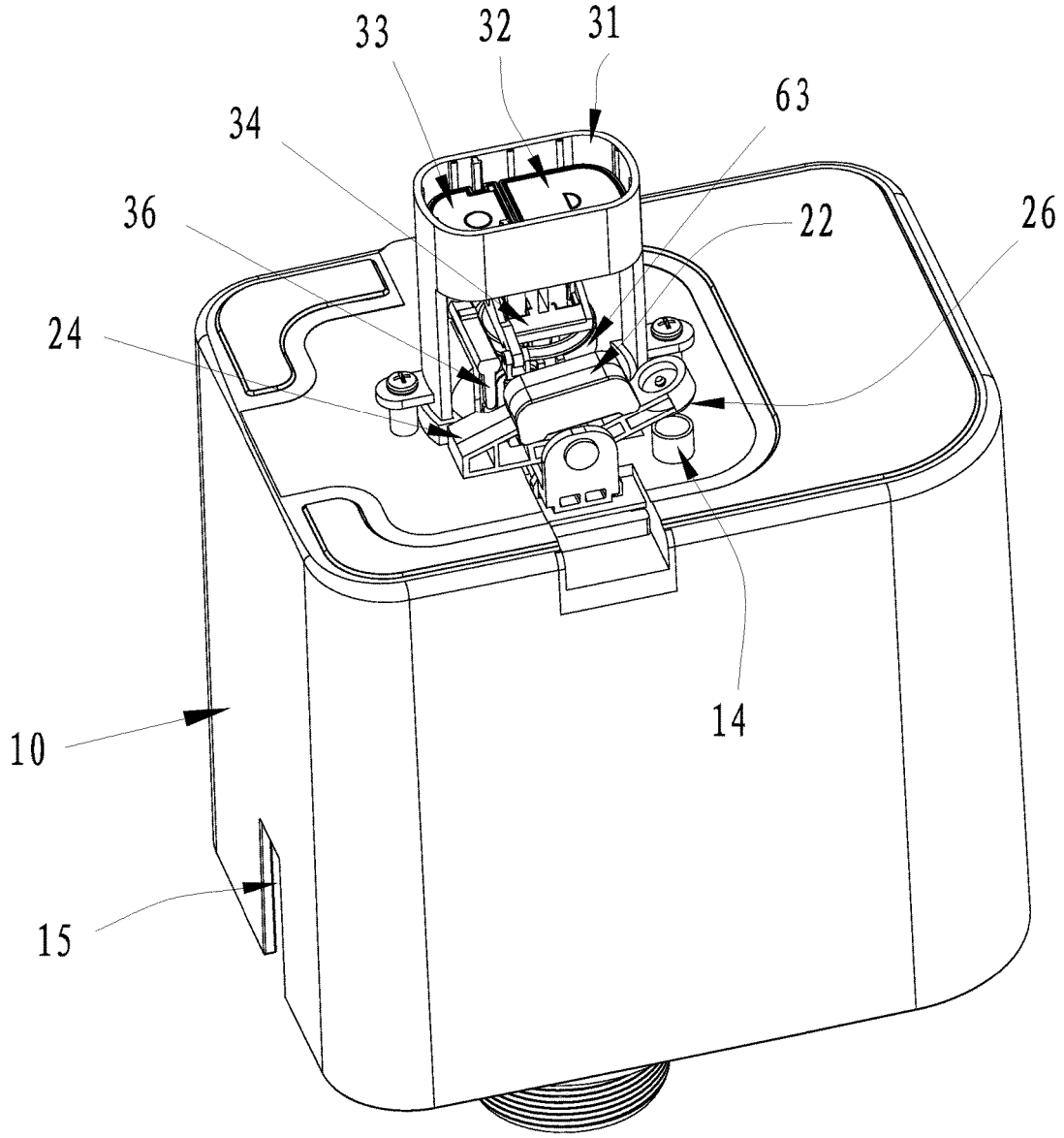
FIG. 8 shows the solid structural sectional view of the embodiment 1 in the present invention when it is at full flush state.

When full flush is needed, as shown in FIGS. 9, 5 and 8, the full flush button 33 of the drain valve controller 30 is pressed, and the full flush is button 33 and the partial flush button 32 move together, and the full flush button return spring 331 and the partial flush button return spring 321 are compressed, the valve rod 63 of the drain valve 60 is pulled up by the swing arm 34 when the partial flush button 32 is pressed, the drain sealing gasket 64 is pulled up from the outlet of drain valve base 62 by the valve rod 63, and the pressing end face 24 of the oscillating rod 22 of the valve unit 20 is pressed down by the strut 36 on the bottom of the full flush button 33 to raise one end of the oscillating rod 22 mounting with the seal cover 26, and the steel ball 28 in the counter weight cavity 27 of the oscillating rod 22 rolls to the end with pressing end face 24, and the seal cover 26 is separated from the air vent 14, and the air vent 14 is opened by the valve unit to communicate the inner cavity 11 of the water container 10 with external normal atmosphere, and the seal of the inner cavity 11 of the water container 10 is got rid of, so that the water body in the water tank 70 and in or out of the inner cavity 11 of the water container 10 is all under normal atmosphere, and water in or out of the inner cavity 11 of the water container 10 is discharged from the water outlet of the drain valve base 62 at the same time to achieve the full flush function of the water tank 70; when full flush work is finished, the full flush button 33 is loosen and reset through the full flush button return spring 331, and the drain valve is turned off to drive the swing arm 34 reset, and the pull rod 35 is pulled up and reset by the resetting of the swing arm 34, the oscillating rod 22 is pulled and raised by the pull rod 35, and the resetting rod of the valve unit is forcibly shut down; the end of the oscillating rod mounting with the seal cover is pressed down through pulling and raising the resetting rod, and the air vent is sealed by the seal cover, and the top of the inner cavity of the water container is sealed, and the drain valve controller 30 and the valve unit 20 are reset, and the initial state of the present invention is reset.

Embodiment 2

An Air Bleeder is Arranged on the Top of the Water Container

Figure 10:
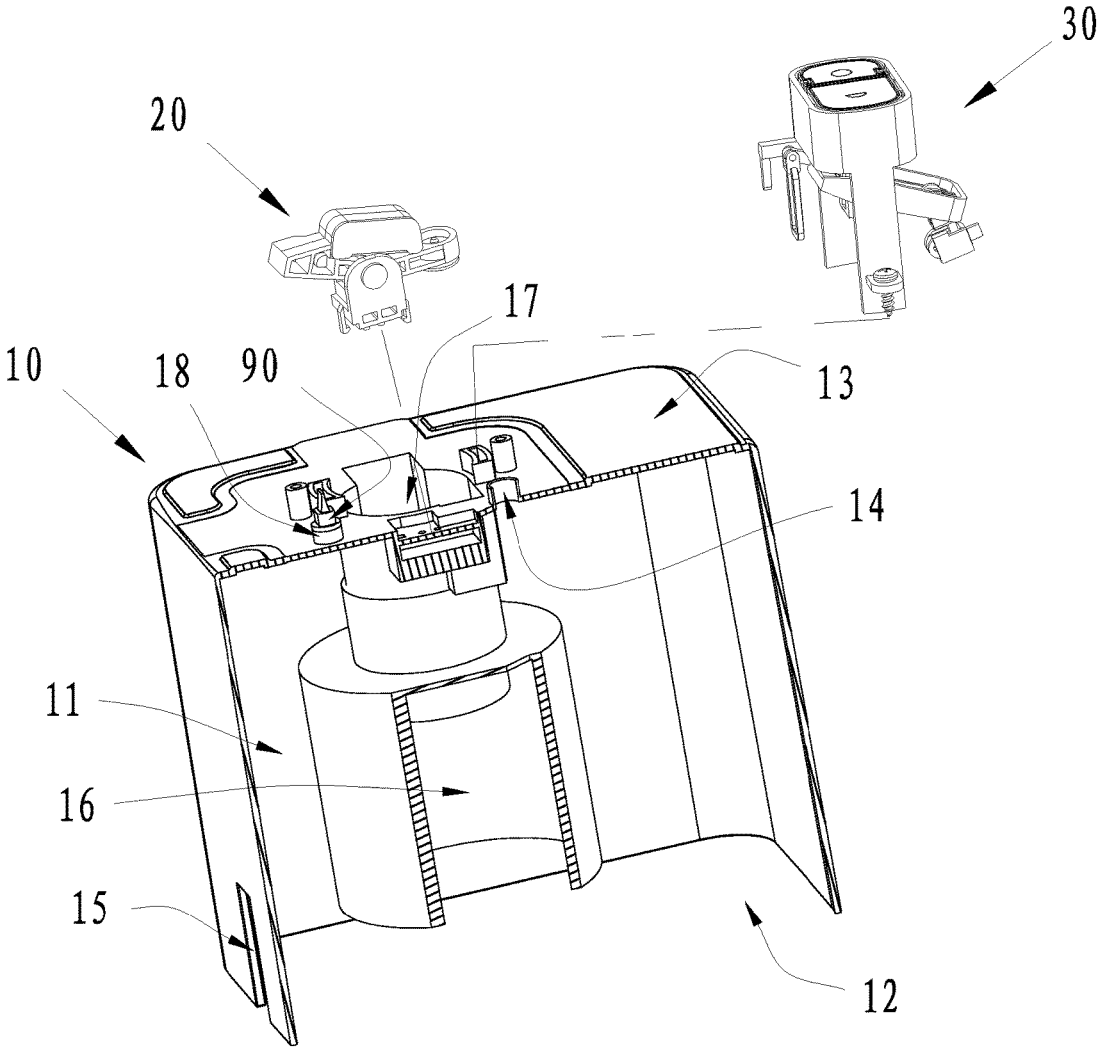
FIG. 10 shows the structural sectional view of the embodiment 2 in the present invention with top-set air bleeder.

The dual-drainage switching mechanism of water tank shown in FIG. 10, the differences from the embodiment 1 are: an air bleeder 18 communicating with the inner cavity 11 is arranged on the top of the water container 10, a exhausting check valve 90 is connected to the air bleeder 18, and the seal cover 46 on the oscillating rod 42 of the valve unit 40 is a rubber piece with no edge upturning, and the air vent 14 is only used for the air inflow of the inner cavity 11, when the air pressure in the inner cavity 11 of the water container 10 is greater than the external normal atmosphere, the inner cavity 11 of the water container 10 is exhausted and released through the exhausting check valve 90, other structure, working principle and implementing action are same to is the embodiment 1.

Embodiment 3

The Valve Unit is at Normally Open State

Figure 11:
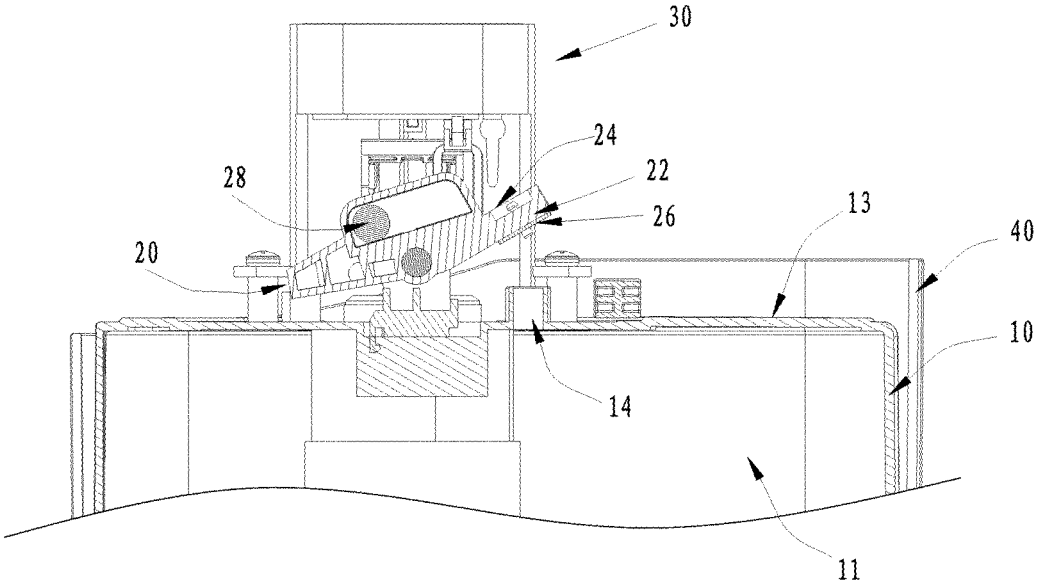
FIG. 11 shows the structural sectional view of the embodiment 3 in the present invention when the valve unit is at normally open state.
Figure 12:
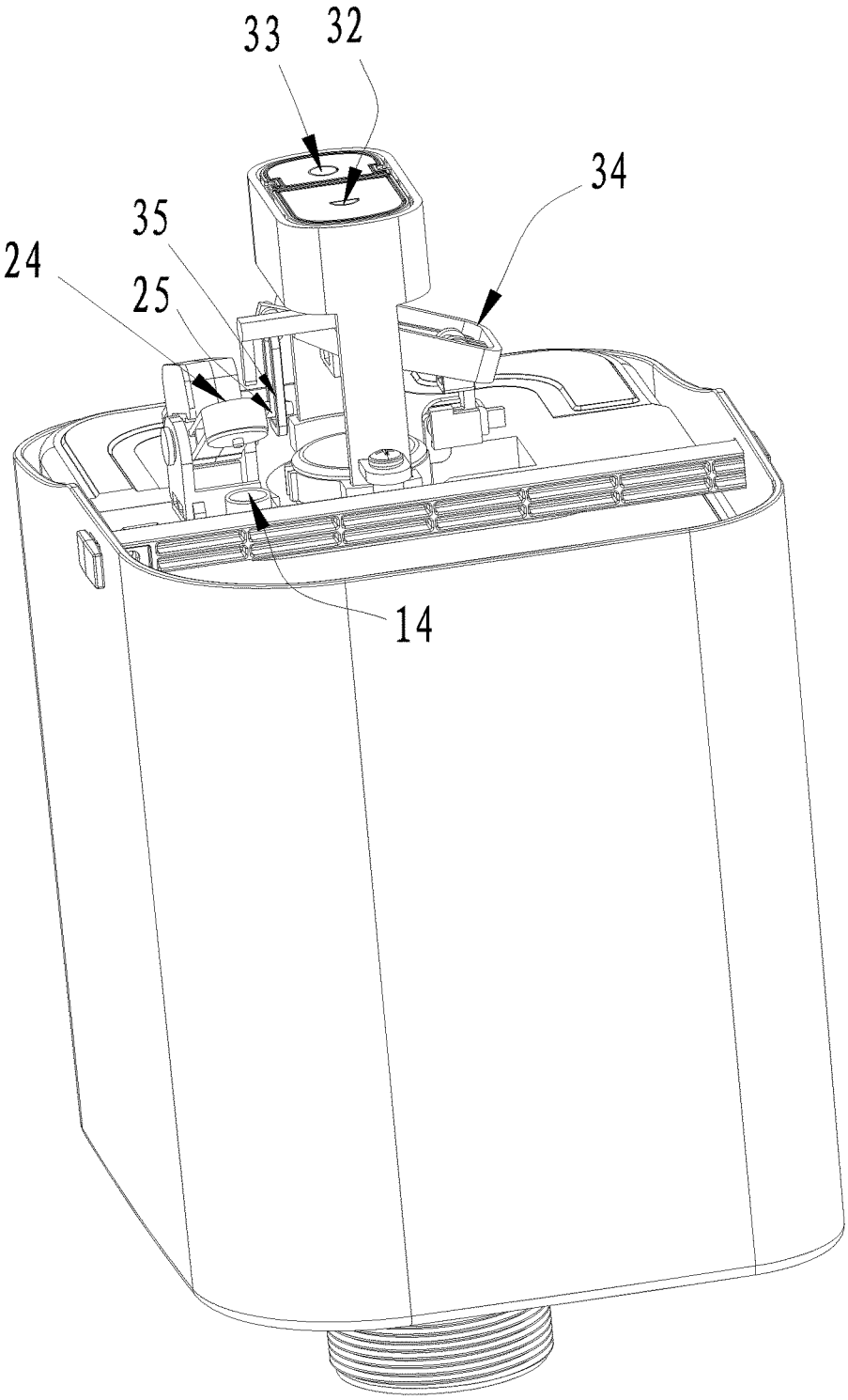
FIG. 12 shows the solid structural view of the embodiment 3 in the present invention when the valve unit is at normally open state.

The dual-drainage switching mechanism of water tank shown in FIGS. 11 and 12, the differences from the embodiment 1 are: the initial state of the valve unit 20 is normally open, the pressing end face 24 is arranged at the end of the oscillating rod 22 mounting with the seal cover, a strut 36 used for pressing the pressing end face 24 is fixed on the bottom of the partial flush button 32, and the strut 36 is above the pressing end face 24 of the oscillating rod 22 of the valve unit 20, and a pull rod 35 is arranged under the full flush button 33, a elongated hang hole 351 is arranged on the pull rod 35, the top end of the pull rod 35 is hinged to the end of the swing arm 34 which is coupling with the resetting rod 25, the resetting rod 25 of the oscillating rod 22 of the valve unit 20 is plunged and coupling with the elongated hang hole 351.

As shown in FIGS. 11 and 12, the present invention is at initial state, and the swing arm 34 is pulled down by the valve rod of the drain valve through gravity, the drain valve base is sealed by the drain sealing gasket at the bottom of the valve rod, another end of the swing arm 34 upwarps and pulls up the pull rod 35, and the resetting rod 25 of the oscillating rod 22 is pulled and raised by the elongated hang hole 351 of the pull rod 35, and the end of the oscillating rod 22 mounting with seal cover 26 is carried up, and the steel ball 28 in the counter weight cavity of the oscillating rod 22 is away from the end with seal cover 26, the air vent 14 of the water container 10 is open, namely the air vent 14 is open at the initial state of the present invention, and the inner cavity 11 of the water container 10 is communicated with atmosphere and is at atmospheric state. The inlet valve is turned on to inject water into the water tank, water in the water tank enters the draining container 40 and the water container 10 through the passage hole and the water inlet, and the water level in the water tank rises, and the water levels in and out of the water container 10 rises simultaneously, and the water stops entering the inlet valve 80, the water levels in the water tank and the inside and the outside of the water container are the same.

When full flush is needed, the full flush button 33 of the drain valve controller 30 is pressed, and the partial flush button 32 keeps still, the pull rod 35 is driven to fall by one end of the swing arm 34, and the elongated hang hole on the pull rod 35 gives way to the resetting rod 25 on the oscillating rod 22, and the steel ball 28 in the oscillating rod 22 of the valve unit 20 is away from the end with seal cover 26, and the air vent 14 is kept open, and the inner cavity 11 of the water container 10 is communicated with atmosphere; the valve rod of the drain valve is pulled up by the other end of the swing arm 34 on the drain valve controller 30, the drain sealing gasket is pulled up from the outlet of is drain valve base by the valve rod, and water in and out of the water container 10 is discharged from the water outlet of the drain valve base through the normal atmosphere environment and the gravity of water, and the full flush function of the water tank is achieved.

When partial flush is needed, the partial flush button 32 of the drain valve controller 30 is pressed, and the full flush button 33 and the partial flush button 32 move together; in the first part of the pressing process of the partial flush button, the drain valve keeps turned off, and the pressing end face 24 of the oscillating rod 22 of the valve unit 20 is pressed down by the strut 36 on the bottom of the partial flush button 32 to press down one end of the oscillating rod 22 mounting with the seal cover 26, and the steel ball 28 in the counter weight cavity 27 of the oscillating rod 22 rolls to the end mounting with the seal cover 26, and the air vent 14 is closed by the seal cover 26 to separate the inner cavity 11 of the water container 10 from the external normal atmosphere to keep the inner cavity 11 of the water container 10 sealed; in the following part of the pressing process of the partial flush button, after the air vent 14 is closed, the valve rod of the drain valve is pulled up by the swing arm 34 when the full flush button 33 is pressed, and the drain valve is turned on, and the water body in the inner cavity 11 of the water container 10 is sealed and stored by atmosphere and cannot flow out, then the partial flush function of the water tank 70 is achieved. When partial flush work is finished, the partial flush button 32 is loosen and reset through the partial flush button return spring, and the drain valve is turned off to drive the swing arm 34 reset, and the pull rod 35 is pulled up and reset by the resetting of the swing arm 34, the oscillating rod is pulled and raised by the pull rod 35, and the resetting rod of the valve unit is forcibly open; the end of the oscillating rod mounting with the seal cover is pulled up through pulling and raising the resetting rod, and the air vent is open, and the top of the inner cavity of the water container is communicated with atmosphere, and the drain valve controller 30 and the valve unit 20 are reset, and the initial state of the present invention is reset.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above, such as, only a button is arranged on the button support in the drain valve controller, and the full flush button and the partial flush button are arranged on the cover of the water tank and are linked with the valve unit; or only a partial flush button is arranged on the button support and the water tank, and the valve control mechanism is controlled through only a switching working as the full flush button; and so on. Therefore, all identical technical proposals are in the scope of the present invention and are all limited by every claim.

What is claimed is:

1. Dual-drainage switching mechanism of water tank, comprising:

a water tank, a water container arranged in the water tank, the water container having an inner cavity with a bottom opening, an air vent communicating with the inner cavity arranged on a sealed top of the water container, a valve unit used for controlling opening and closing of the air vent, and a drain valve controller comprising a partial flush button and a full flush button, wherein:

water flows into the water container and is discharged from the water container via a drain valve base under action of an atmosphere and a weight of the water, the air vent is opened through linking and coupling of the full flush button and the valve unit to communicate between the inner cavity of the water container and the atmosphere, when fully flushing the water tank, and the air vent is closed through linking and coupling of the partial flush button and the valve unit to keep the inner cavity of the water container sealed from the atmosphere to prevent water from flowing out of the inner cavity, when partially flushing the water tank.

2. Dual-drainage switching mechanism of water tank according to claim 1, wherein, a pressure relief device used for exhausting when the inner pressure of the water container is greater than atmospheric pressure is arranged on the water container.

3. Dual-drainage switching mechanism of water tank according to claim 2, wherein, the pressure relief device is arranged on the valve unit, the exhausting and inhaling of the air vent is controlled through the coupling of the pressure relief device and the air vent controlled by the valve unit.

4. Dual-drainage switching mechanism of water tank according to claim 1, wherein, the valve unit comprises a fixed seat fixed on the top of the water container, a oscillating rod linked with the drain valve controller, the middle of the bottom of the oscillating rod is connected to the fixed seat in a swinging manner through the pin roll, a seal cover sealing the air vent is arranged at one end of the oscillating rod.

5. Dual-drainage switching mechanism of water tank according to claim 2, wherein, the seal cover on the oscillating rod of the valve unit is a pressure relief device formed by a thin rubber piece, when the pressure in the inner cavity of the water container is greater than the external atmosphere, the edge of the rubber piece upturns elastically to form a gap with the air vent, and the gap reliefs the pressure in the inner cavity of the water container.

6. Dual-drainage switching mechanism of water tank according to claim 4, wherein, a pressing end face which opens the valve unit when the full flush button of the drain valve controller presses the oscillating rod is arranged at one end of the oscillating rod of the valve unit.

7. Dual-drainage switching mechanism of water tank according to claim 4, wherein, a resetting rod which pulls and raises the oscillating rod to forcedly close the valve unit when the partial flush button of the drain valve controller returns is arranged at another end of the oscillating rod of the valve unit.

8. Dual-drainage switching mechanism of water tank according to claim 4, wherein, a counter weight cavity and a buckling cover that buckles and covers the counter weight cavity are arranged in the oscillating rod of the valve unit, a steel ball that can rolls back and forth in the counter weight cavity along two ends of the oscillating rod is arranged in the counter weight cavity.

9. Dual-drainage switching mechanism of water tank according to claim 1, wherein, the drain valve controller also comprises a button support that is fixed above the water container, the partial flush button and the full flush button are respectively sleeved with partial flush button return spring and full flush button return spring and are both mounted on the button support, a swing arm of which one end is actively connected to a valve rod of the drain valve is hinged under the button support, the partial flush button and the full flush button are linked to and coupling with the swing arm;

the full flush button keeps still when the partial flush button is pressed, and the full flush button drives the partial flush button to move together when the full flush button is pressed.

10. Dual-drainage switching mechanism of water tank according to claim 6, wherein, a strut used for pressing the pressing end face is fixed on the bottom of the full flush button, and the strut is above the pressing end face of the oscillating rod of the valve unit.

11. Dual-drainage switching mechanism of water tank according to claim 9, wherein, a pull rod is arranged under the partial flush button of the drain valve controller, a elongated hang hole is arranged on the pull rod, the top end of the pull rod is hinged to another end of the swing arm, the resetting rod of the oscillating rod of the valve unit is plunged and coupling with the elongated hang hole.

12. Dual-drainage switching mechanism of water tank according to claim 1, wherein, a normal pressure cavity isolated from the inner cavity and used for mounting the drain valve is arranged in the water container, the top opening of the normal pressure cavity is opened on the sealed top of the water container;

a draining container is further arranged out of the water container to sleeved with the water container; a mounting hole for mounting the drain valve base is arranged on the bottom surface of the draining container, at least one water inlet is arranged on the bottom of the side wall of the water container, and at least one passage hole that is communicated with and fits the water inlet is arranged on the side of the draining container.

13. Dual-drainage switching mechanism of water tank according to claim 11, wherein, two location holes arranged at the two side walls of the draining container, and a batten is inserted in the two location holes, one end of the batten is locked with the draining container another end is fixed connected through a buckle, the batten is used for pressing the water container to fix to and sleeved with draining container.

14. Dual-drainage switching mechanism of water tank according to claim 2, wherein, an air bleeder communicating with the inner cavity is arranged on the top of the water container, the pressure relief device is a exhausting check valve, and the exhausting check valve is connected to the air bleeder.

15. Dual-drainage switching mechanism of water tank according to claim 4, wherein, the seal cover on the oscillating rod of the valve unit is a pressure relief device formed by a thin rubber piece, when the pressure in the inner cavity of the water container is greater than the external atmosphere, the edge of the rubber piece upturns elastically to form a gap with the air vent, and the gap reliefs the pressure in the inner cavity of the water container.

16. Dual-drainage switching mechanism of water tank according to claim 3, wherein, the drain valve controller also comprises a button support that is fixed above the water container, the partial flush button and the full flush button are respectively sleeved with partial flush button return spring and full flush button return spring and are both mounted on the button support, a swing arm of which one end is actively connected to a valve rod of the drain valve is hinged under the button support, the partial flush button and the full flush button are linked to and coupling with the swing arm;

the full flush button keeps still when the partial flush button is pressed, and the full flush button drives the partial flush button to move together when the full flush button is pressed.

17. Dual-drainage switching mechanism of water tank according to claim 4, wherein, the drain valve controller also comprises a button support that is fixed above the water container, the partial flush button and the full flush button are respectively sleeved with partial flush button return spring and full flush button return spring and are both mounted on the button support, a swing arm of which one end is actively connected to a valve rod of the drain valve is hinged under the button support, the partial flush button and the full flush button are linked to and coupling with the swing arm;

the full flush button keeps still when the partial flush button is pressed, and the full flush button drives the partial flush button to move together when the full flush button is pressed.

18. Dual-drainage switching mechanism of water tank according to claim 6, wherein, the drain valve controller also comprises a button support that is fixed above the water container, the partial flush button and the full flush button are respectively sleeved with partial flush button return spring and full flush button return spring and are both mounted on the button support, a swing arm of which one end is actively connected to a valve rod of the drain valve is hinged under the button support, the partial flush button and the full flush button are linked to and coupling with the swing arm;

the full flush button keeps still when the partial flush button is pressed, and the full flush button drives the partial flush button to move together when the full flush button is pressed.

19. Dual-drainage switching mechanism of water tank according to claim 16, wherein, a pull rod is arranged under the partial flush button of the drain valve controller, a elongated hang hole is arranged on the pull rod, the top end of the pull rod is hinged to another end of the swing arm, the resetting rod of the oscillating rod of the valve unit is plunged and coupling with the elongated hang hole.

20. Dual-drainage switching mechanism of water tank according to claim 17, wherein, a pull rod is arranged under the partial flush button of the drain valve controller, a elongated hang hole is arranged on the pull rod, the top end of the pull rod is hinged to another end of the swing arm, the resetting rod of the oscillating rod of the valve unit is plunged and coupling with the elongated hang hole.

21. Dual-drainage switching mechanism of water tank according to claim 18, wherein, a pull rod is arranged under the partial flush button of the drain valve controller, a elongated hang hole is arranged on the pull rod, the top end of the pull rod is hinged to another end of the swing arm, the resetting rod of the oscillating rod of the valve unit is plunged and coupling with the elongated hang hole.

22. Dual-drainage switching mechanism of water tank according to claim 2, wherein, a normal pressure cavity isolated from the inner cavity and used for mounting the drain valve is arranged in the water container, the top opening of the normal pressure cavity is opened on the sealed top of the water container;

a draining container is further arranged out of the water container to sleeved with the water container;

a mounting hole for mounting the drain valve base is arranged on the bottom surface of the draining container, at least one water inlet is arranged on the bottom of the side wall of the water container, and at least one passage hole that is communicated with and fits the water inlet is arranged on the side of the draining container.

23. Dual-drainage switching mechanism of water tank according to claim 3, wherein, a normal pressure cavity isolated from the inner cavity and used for mounting the drain valve is arranged in the water container, the top opening of the normal pressure cavity is opened on the sealed top of the water container;

a draining container is further arranged out of the water container to sleeved with the water container;

a mounting hole for mounting the drain valve base is arranged on the bottom surface of the draining container, at least one water inlet is arranged on the bottom of the side wall of the water container, and at least one passage hole that is communicated with and fits the water inlet is arranged on the side of the draining container.

24. Dual-drainage switching mechanism of water tank according to claim 19, wherein, two location holes arranged at the two side walls of the draining container, and a batten is inserted in the two location holes, one end of the batten is locked with the draining container another end is fixed connected through a buckle, the batten is used.

25. Dual-drainage switching mechanism of water tank according to claim 20, wherein, two location holes arranged at the two side walls of the draining container, and a batten is inserted in the two location holes, one end of the batten is locked with the draining container another end is fixed connected through a buckle, the batten is used.

26. Dual-drainage switching mechanism of water tank according to claim 21, wherein, two location holes arranged at the two side walls of the draining container, and a batten is inserted in the two location holes, one end of the batten is locked with the draining container another end is fixed connected through a buckle, the batten is used.

* * * * *